US008830795B2

(12) United States Patent
Rubin

(10) Patent No.: US 8,830,795 B2
(45) Date of Patent: Sep. 9, 2014

(54) APPARATUS FOR TRACKING TIME FOR CONTACT LENSES

(76) Inventor: Harris Rubin, Arlington, VA (US)

( * ) Notice: Subject to any disclaimer, the term of this patent is extended or adjusted under 35 U.S.C. 154(b) by 714 days.

(21) Appl. No.: 13/027,317

(22) Filed: Feb. 15, 2011

(65) Prior Publication Data

US 2012/0204782 A1 Aug. 16, 2012

(51) Int. Cl.

| | |
|---|---|
| ***G04B 47/00*** | (2006.01) |
| ***G04F 10/00*** | (2006.01) |
| ***G09F 9/00*** | (2006.01) |
| ***A45C 11/04*** | (2006.01) |
| ***B65D 51/00*** | (2006.01) |
| ***G04F 3/06*** | (2006.01) |
| ***G04F 1/00*** | (2006.01) |
| ***G04G 11/00*** | (2006.01) |
| ***G04G 13/00*** | (2006.01) |
| *A45C 11/00* | (2006.01) |

(52) U.S. Cl.

CPC *G04F 3/06* (2013.01); *G04F 1/005* (2013.01); *G04G 11/00* (2013.01); *G04G 13/00* (2013.01); *A45C 11/005* (2013.01)

USPC ..... 368/10; 368/107; 116/308; 206/5.1; 215/230

(58) Field of Classification Search

CPC ..... G04F 1/00; G04F 1/005; G04F 3/00; G04F 10/00; A45C 11/005

USPC ..... 368/10, 28, 29, 72–73, 107–109; 116/307–309; 206/5.1, 534; 215/230

See application file for complete search history.

(56) References Cited

U.S. PATENT DOCUMENTS

| | | | | |
|---|---|---|---|---|
| 4,011,829 | A * | 3/1977 | Wachsmann et al. | 116/308 |
| 4,345,541 | A * | 8/1982 | Villa-Real | 116/308 |
| 4,347,804 | A * | 9/1982 | Villa-Real | 116/308 |
| 4,361,408 | A * | 11/1982 | Wirtschafter | 368/10 |
| 4,511,050 | A * | 4/1985 | Nicol | 215/219 |
| 4,909,382 | A | 3/1990 | Cuppari | |
| 5,233,571 | A * | 8/1993 | Wirtschafter | 368/10 |
| 5,280,834 | A * | 1/1994 | Berkley | 206/5.1 |
| 5,347,453 | A * | 9/1994 | Maestre | 705/2 |
| 5,452,792 | A * | 9/1995 | Zautke et al. | 206/5.1 |
| 5,720,392 | A * | 2/1998 | Price | 206/534 |

(Continued)

FOREIGN PATENT DOCUMENTS

| | | |
|---|---|---|
| EP | 1949813 | 7/2010 |
| WO | WO 2004/024573 | 3/2004 |
| WO | WO 2007146627 | 12/2007 |

OTHER PUBLICATIONS

Innovative Storage Devices Remind Contact Lens Wearers to Replace Lenses, Contact Lens Headlines, http://www.contactlensheadlines.com/1282/contact-lensstorage/ (Dec. 15, 2010).

(Continued)

*Primary Examiner* — Vit W Miska

(74) *Attorney, Agent, or Firm* — LeonardPatel PC; Michael A. Leonard, II; Sheetal S. Patel

(57) ABSTRACT

An apparatus for tracking time for contact lenses is provided. The timer is configured to track a time that one or more contact lenses have been stored in a contact lens case. A securing mechanism is configured to secure the timer to a cap of the contact lens case.

9 Claims, 13 Drawing Sheets

(56) References Cited

U.S. PATENT DOCUMENTS

| | | | | |
|---|---|---|---|---|
| 6,038,997 | A * | 3/2000 | Madden | 116/308 |
| 6,259,794 | B1 * | 7/2001 | Dobbins | 381/124 |
| 6,373,786 | B1 * | 4/2002 | Kagan et al. | 368/10 |
| 6,382,409 | B1 | 5/2002 | Scala | |
| 6,633,796 | B1 * | 10/2003 | Pool et al. | 700/231 |
| 6,667,936 | B1 * | 12/2003 | Ditzig | 368/10 |
| 6,710,703 | B2 * | 3/2004 | Huang | 340/309.16 |
| 6,845,064 | B2 * | 1/2005 | Hildebrandt | 368/10 |
| D512,565 | S * | 12/2005 | Sasso | D3/264 |
| 7,042,805 | B1 * | 5/2006 | Kallman | 368/10 |
| D525,538 | S * | 7/2006 | Oas | D10/40 |
| 7,204,614 | B2 | 4/2007 | Hanis et al. | |
| 7,236,428 | B1 * | 6/2007 | Morse | 368/10 |
| 7,314,022 | B2 * | 1/2008 | Sollaccio | 116/308 |
| 7,362,660 | B2 * | 4/2008 | Hildebrandt | 368/10 |
| 7,397,347 | B1 * | 7/2008 | Joyce | 340/309.16 |
| 7,623,295 | B2 | 11/2009 | Sabeta | |
| 7,628,269 | B2 | 12/2009 | O'Hara et al. | |
| 7,661,383 | B2 * | 2/2010 | Song | 116/308 |
| 7,832,551 | B2 | 11/2010 | Newman et al. | |
| 7,907,477 | B2 * | 3/2011 | Puzia | 368/10 |
| 2005/0041531 | A1 * | 2/2005 | Sekura | 368/10 |
| 2005/0078481 | A1 | 4/2005 | Hanis et al. | |
| 2005/0121407 | A1 * | 6/2005 | Hildebrandt | 215/228 |
| 2005/0258053 | A1 * | 11/2005 | Sieg | 206/5.1 |
| 2007/0274626 | A1 | 11/2007 | Sabeta | |
| 2007/0284263 | A1 | 12/2007 | Giardina et al. | |
| 2008/0179200 | A1 | 7/2008 | O'Hara et al. | |
| 2009/0084305 | A1 * | 4/2009 | Song | 116/308 |
| 2009/0283118 | A1 | 11/2009 | Zakutin | |
| 2010/0065625 | A1 | 3/2010 | Sabeta | |
| 2010/0259719 | A1 | 10/2010 | Sabeta | |

OTHER PUBLICATIONS

LED Contact Lens Case with Countdown Timer, Gadget Lab—Charlie Sorrel, http://www.wired.com/gadgetlab/2008/11/led-contact-len/ (Nov. 4, 2008).

* cited by examiner

APPARATUS FOR TRACKING TIME FOR CONTACT LENSES

BACKGROUND

1. Field

The present invention generally relates to an apparatus for tracking time. More specifically, the present invention relates to an apparatus for tracking time for contact lenses.

2. Description of the Related Art

Timers for contact lenses are known where the contact lens case either sits directly upon the timer or the timer is inseparably integrated into the base of the contact lens case. The timers may be digital, and may be capable of being reset by a user when the designated period expires. Variable periods may be presented to, and selected by, the user in some cases. Certain non-digital counters are also known that a user must manipulate by hand, but the periods of such counters are non-variable.

SUMMARY

Certain embodiments of the present invention may provide solutions to the problems and needs in the art that have not yet been fully solved by conventional timers for contact lens cases. For example, certain embodiments of the present invention provide a timer or counter that is securable to a contact lens case cap.

In one embodiment of the present invention, an apparatus includes a timer configured to track a time that one or more contact lenses have been stored in a contact lens case. The apparatus also includes a securing mechanism configured to secure the timer to a cap of the contact lens case.

In another embodiment of the present invention, an apparatus includes a timer configured to track a time that one or more contact lenses have been stored in a contact lens case. The apparatus also includes a post member operably connected to the timer and a strap operably connected to the post member. The post member and the strap secure the timer to a contact lens case cap.

In yet another embodiment of the present invention, an apparatus includes a manual counter including numbers representing a lifetime of one or more contact lenses. The apparatus also includes a securing mechanism configured to secure the manual counter to a contact lens case cap.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION

It will be readily understood that the components of various embodiments of the present invention, as generally described and illustrated in the figures herein, may be arranged and designed in a wide variety of different configurations. Thus, the following more detailed description of the embodiments of apparatuses of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

Certain embodiments of the present invention provide a timer or counter that is securable to a contact lens case cap. Such a configuration has potential benefits over the art. For instance, such a timer is not limited to a single contact lens case, and can be moved to a new case if the other cap for the current case is lost or the case becomes dirty or marked. Also, a timer can be manufactured such that it is easily securable to contact lens caps of varying sizes. Accordingly, many embodiments of the present invention enjoy significant advantages over the art.

Figure 1:
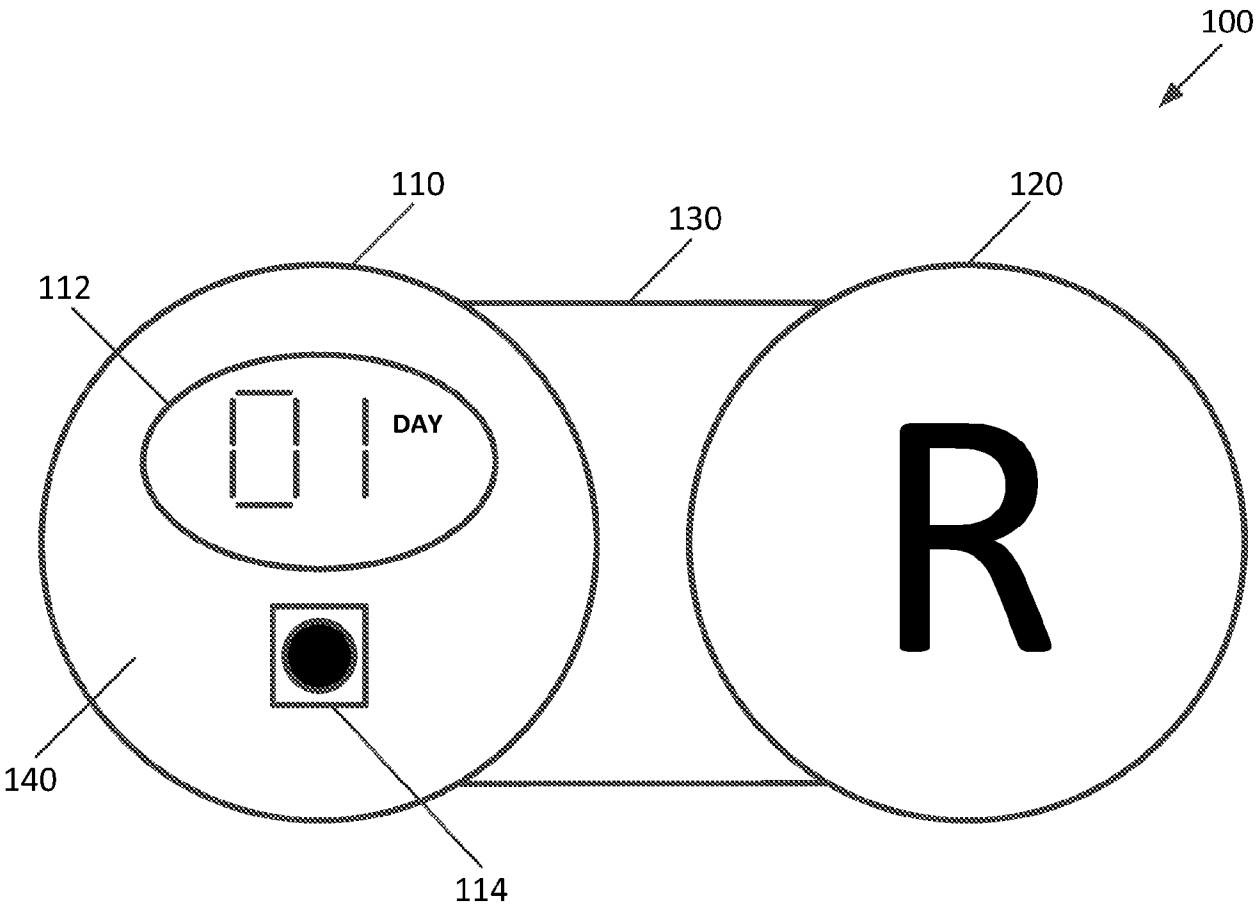
FIG. 1 is a top view of a contact lens case with a timer secured to the left contact lens cap, according to an embodiment of the present invention.

FIG. 1 is a top view of a contact lens case 100 with a timer 110 secured to the left contact lens case cap, according to an embodiment of the present invention. In some embodiments, a manual counter is used in lieu of a timer. The contact lens case includes a base 130, a left contact lens case cap (obscured from view by timer 110 and securing mechanism 140), a right contact lens case cap 120, a timer 110, and a securing mechanism 140. Timer 110 is shown secured to the left contact lens case cap in this embodiment, but timer 110 could also be secured to right contact lens case cap 120. Also, while only one timer is shown in this embodiment, a person of ordinary skill in the art will recognize that it is possible to secure a second timer to right contact lens case cap 120. Such a configuration would allow tracking of the left and right contact lenses separately in case one has been lost or damaged and replaced at a different time, or the left and right contact lenses have different times until needing to be replaced, assuming that timer 110 only has functionality for tracking one time period.

Timer 110 is secured around the left contact lens case cap, but does not interfere with the left contact lens case cap attaching to base 130. Timer 110 has a digital display 112 and a reset button 114. Digital counter 112 can either count up or count down to the number of days remaining in the lifetime of the contact lenses, depending on design choice, and digital display 112 may take any shape. The number of days may be fixed or adjustable by the user (for instance, options of 14 days, 30 days, 60 days, etc. may be provided). Also, while days are shown in this embodiment, hours, minutes, seconds, and/or any other time period or combination of time periods may be shown on digital display 112. In some embodiments, digital display 112 may provide separate counters for both the left and right contact lenses.

Reset button 114 resets the value of digital display 112 to a predetermined or user-selected value. Other buttons may also be present to facilitate selecting different timer values, setting an alarm that goes off when the time period expires, etc. In embodiments where alarm functionality is provided, speakers would also generally be present in timer 110, although a separate and/or remote speaker setup is possible, where the speakers are either hard-wired or remotely accessible by, for example, a radio signal or any other carrier means. While a digital display is provided in this embodiment, a non-digital counter that a user physically manipulates is also possible in addition to, or in lieu of, digital display 112. Such a non-digital counter could be, for instance, a wheel with numbers corresponding to days of remaining contact lens lifetime (see, for example, FIG. 11).

In this embodiment, securing mechanism 140 completely envelops timer 110, save for an opening for digital display 112 and reset button 114. Securing mechanism 140 may also envelop the back of timer 110, sitting between timer 110 and the left contact lens case cap. Securing mechanism 140 may be manufactured from rubber, plastic, cloth, or any other material suitable material. In some embodiments, rubber may be preferable due to its elasticity. Securing mechanism 140 may be attached to timer 110 or may simply slide over timer 110 and hold timer 110 in place against the contact lens case cap. Such a securing mechanism may enable timer 110 to be secured to contact lens case caps of varying sizes, reducing or eliminating the need to manufacture multiple sizes. This feature may allow such embodiments to be manufactured more cost effectively.

Figure 2:
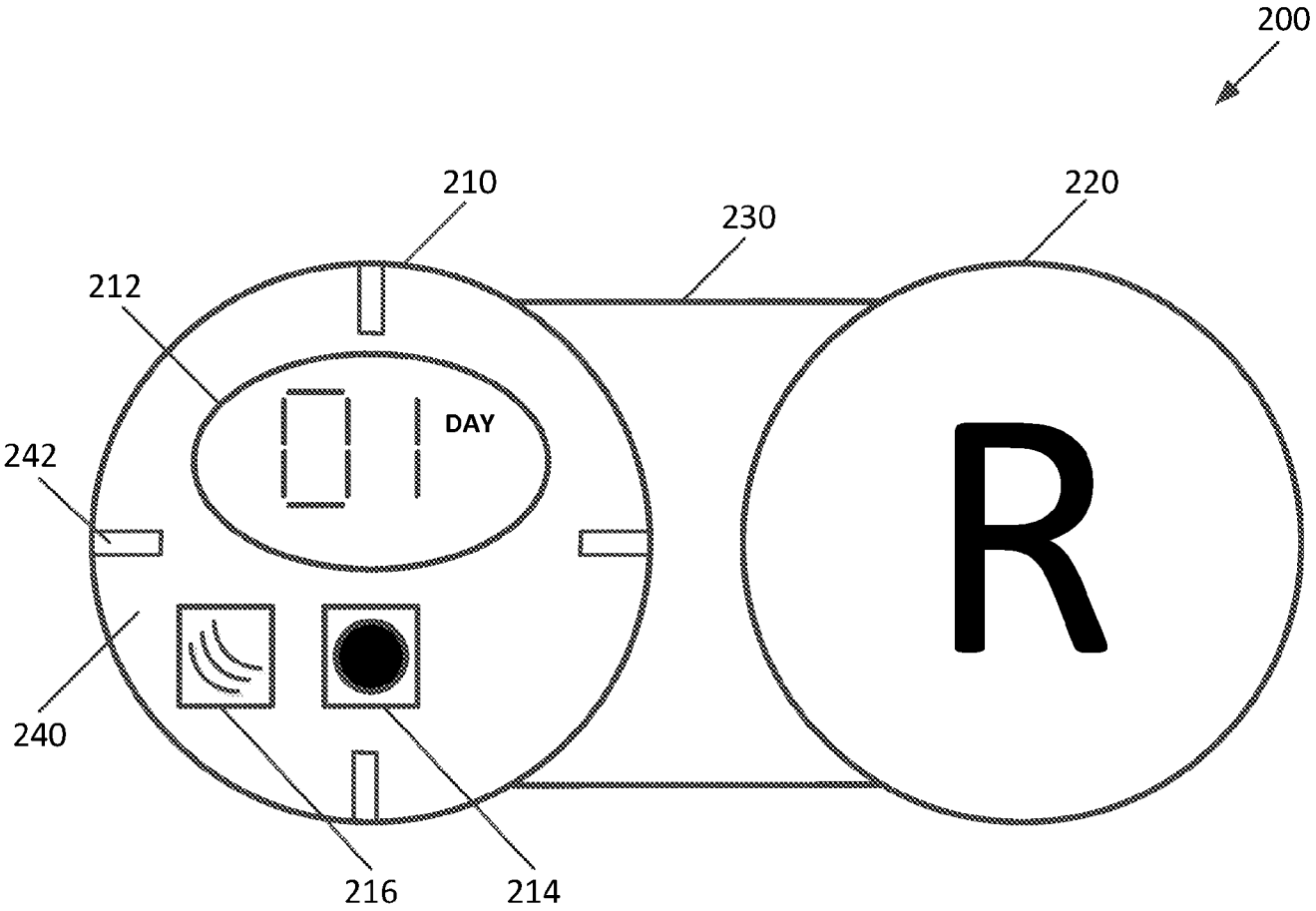
FIG. 2 is a top view of a contact lens case with a timer secured to the left contact lens cap, according to an embodiment of the present invention.

FIG. 2 is a top view of a contact lens case 200 with a timer 210 secured to the left contact lens cap, according to an embodiment of the present invention. In some embodiments, contact lens case 200 may be the same as contact lens case 100 of FIG. 1. The contact lens case includes a base 230, a left contact lens case cap (obscured from view by timer 210 and securing mechanism 240), a right contact lens case cap 220, a timer 210, and a securing mechanism 240. Timer 210 is secured around the left contact lens case cap, but does not interfere with the left contact lens case cap attaching to base 230. Timer 210 has a digital display 212, a reset button 214, and a speaker 216. Reset button 114 resets the value of digital display 112 to a predetermined or user-selected value. Speaker 216 permits the generation of sounds including, for example, acknowledgement beeps when a user presses the reset button and generating an alarm then the lifetime of the contact lenses expires.

In this embodiment, securing mechanism 240 completely envelops timer 210, save for an opening for digital display 212, reset button 214 and speaker 216. Securing mechanism 240 includes gaps 242 around the periphery of securing mechanism 240. Such gaps may allow the material of securing mechanism to flex more easily in order to be securable to a contact lens case cap.

Figure 3:
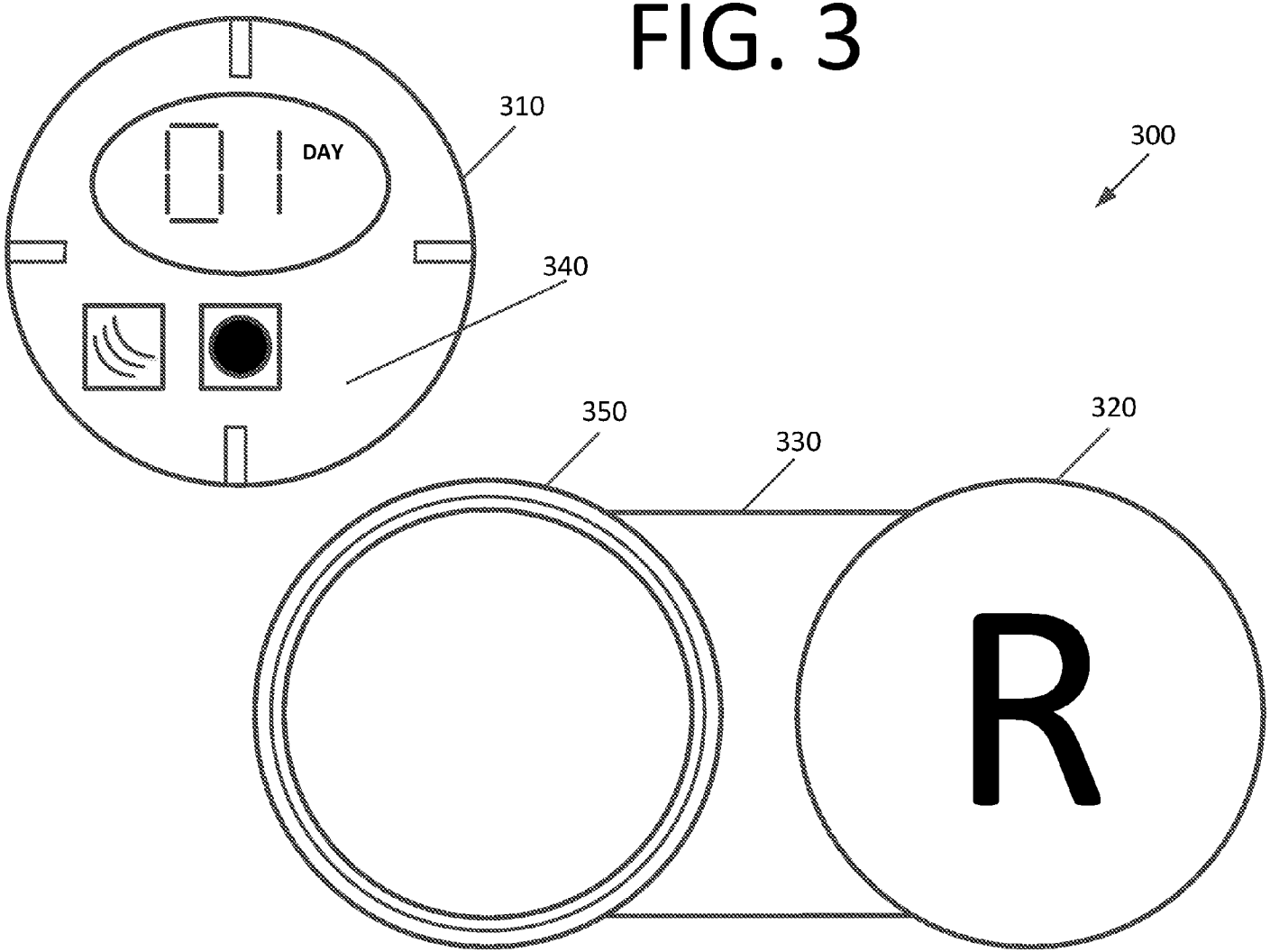
FIG. 3 is a top view of a contact lens case with a timer secured to the left contact lens cap where the timer and left contact lens cap have been removed, according to an embodiment of the present invention.

FIG. 3 is a top view of a contact lens case 300 with a timer 310 secured to the left contact lens cap where timer 310 and the left contact lens cap have been removed, according to an embodiment of the present invention. In some embodiments, contact lens case 300 may be the same as contact lens case 200 of FIG. 2. The contact lens case includes a base 330, a left contact lens case cap (obscured from view by timer 310 and securing mechanism 340), a right contact lens case cap 320, a timer 310, a securing mechanism 340, and a left contact lens receptacle 350. Timer 310 is secured around the left contact lens case cap, but the left contact lens cap is still removable, as seen in FIG. 3.

Figure 4:
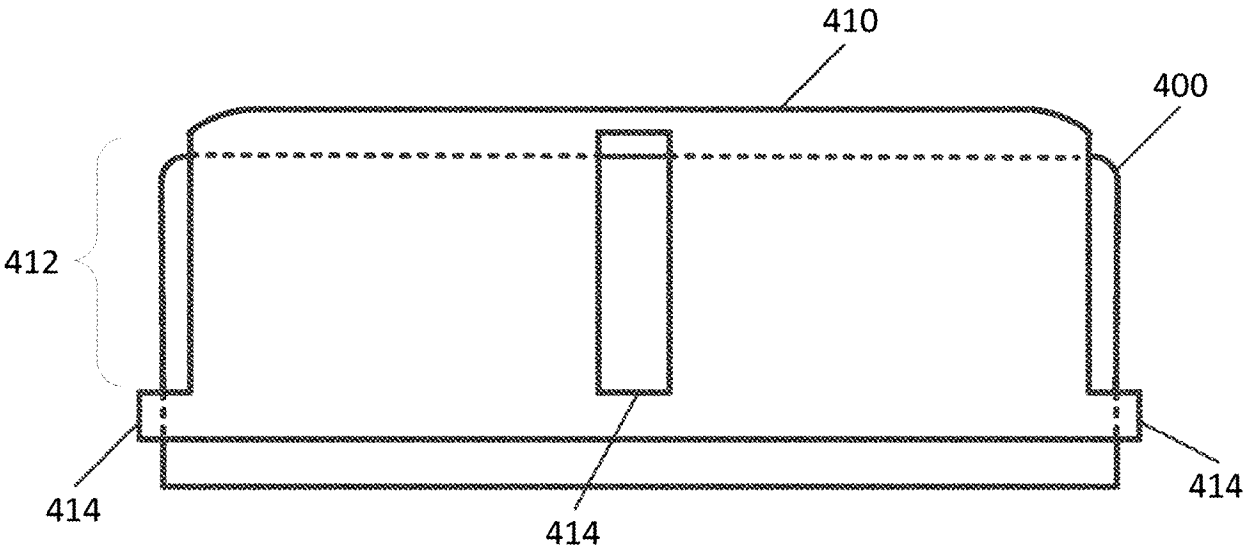
FIG. 4 is a side view of a contact lens case cap and a securing mechanism, according to an embodiment of the present invention.

FIG. 4 is a side view of a contact lens case cap 400 and a securing mechanism 410, according to an embodiment of the present invention. In some embodiments, contact lens case cap 400 and securing mechanism 410 may be present in the contact lens cases of FIGS. 2 and 3. Securing mechanism 410, which houses a timer (not shown), wraps around contact lens case cap 400. The extent to which securing mechanism 410 covers contact lens case cap 400 is a matter of design choice.

In this embodiment, securing mechanism 410 has gaps such as gap 412 to allow securing mechanism 410 to more easily attach to contact lens case cap 400. However, not all embodiments have such gaps. Strips 414 are formed in the material of securing mechanism 410 and are located below gaps 412 in order to facilitate a better fit with contact lens case cap 400.

Figure 5A:
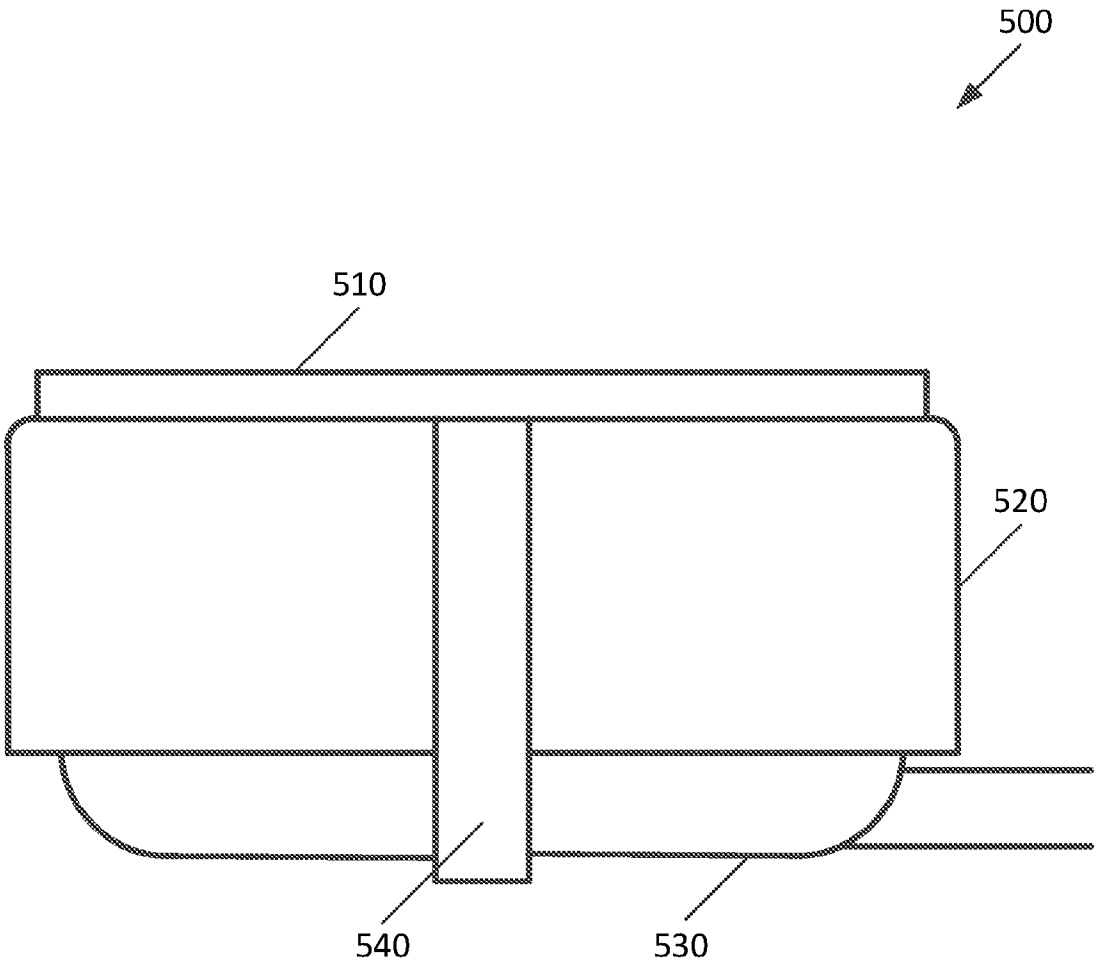
FIG. 5A is a side view of a contact lens case with a timer that fastens to both the contact lens case and a contact lens case cap, according to an embodiment of the present invention.

FIG. 5A is a side view of a contact lens case 500 with a timer 510 that fastens to both a base 530 of contact lens case 500 and a contact lens case cap 520, according to an embodiment of the present invention. In some embodiments, a manual counter is used in lieu of a timer. A strap 540 is operably connected to timer 510 and secures timer 510 to contact lens case 500 by wrapping around contact lens case cap 520 and base 530. Strap 540 may be secured by tension where strap 540 is made of an elastic material such as rubber. Strap 540 may include two or more parts, and in such a case, may also be secured by another suitable mechanism, including a buckle, a snap, a notch on one part and a peg on another, or any other mechanism suitable for securing timer 510 to contact lens case 500. A backing made of rubber, adhesive material, or any other material suitable for deterring against timer 510 slipping on contact lens case cap 520 may be placed on the back of timer 510 so as to be positioned between timer 510 and contact lens case cap 520.

Figure 5B:
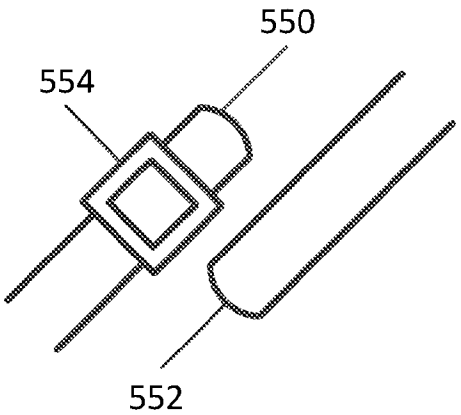
FIG. 5B is a top view of a strap for a timer with a buckle, according to an embodiment of the present invention.

FIG. 5B is a top view of a strap for a timer with a buckle 554, according to an embodiment of the present invention.

The strap includes a left strip 550 and a right strip 552. Left strip 550 has buckle 554. Right strip 552 may be threaded through buckle 554 of left strip 550 so as to secure the timer around a contact lens case cap and a base.

Figure 5C:
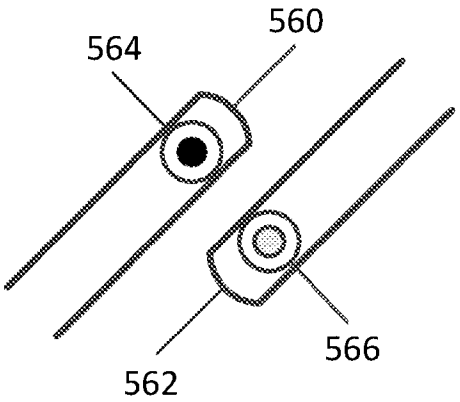
FIG. 5C is a top view of a strap with a snap, according to an embodiment of the present invention.

FIG. 5C is a top view of a strap with a snap, according to an embodiment of the present invention. The strap includes a left strip 560 and a right strip 562. Left strip 560 contains a half of the snap with a protrusion 564, which extends outward from left strip 560. Right strip 562 contains a half of the snap with a hole 566, such that protrusion 564 can engage with hole 566. In order for protrusion 564 and hole 566 to fasten to one another, either left strip 560 or right strip 562 would be facing the opposite direction as shown.

Figure 5D:
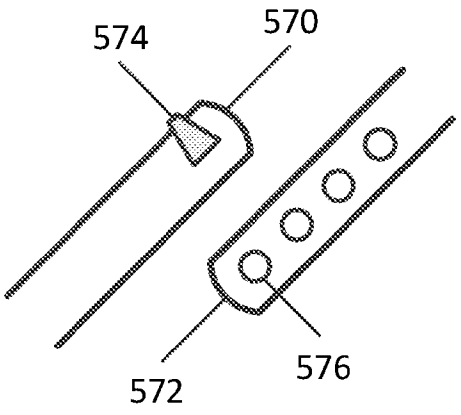
FIG. 5D is a top view of a strap with a notch and a peg, according to an embodiment of the present invention.

FIG. 5D is a top view of a strap with a notch 574 and a peg 576, according to an embodiment of the present invention. The strap contains a left strip 570 and a right strip 572. Left strip 570 includes peg 574. Right strip 572 several holes 576, such that peg 574 can engage with one of holes 576.

Figure 6:
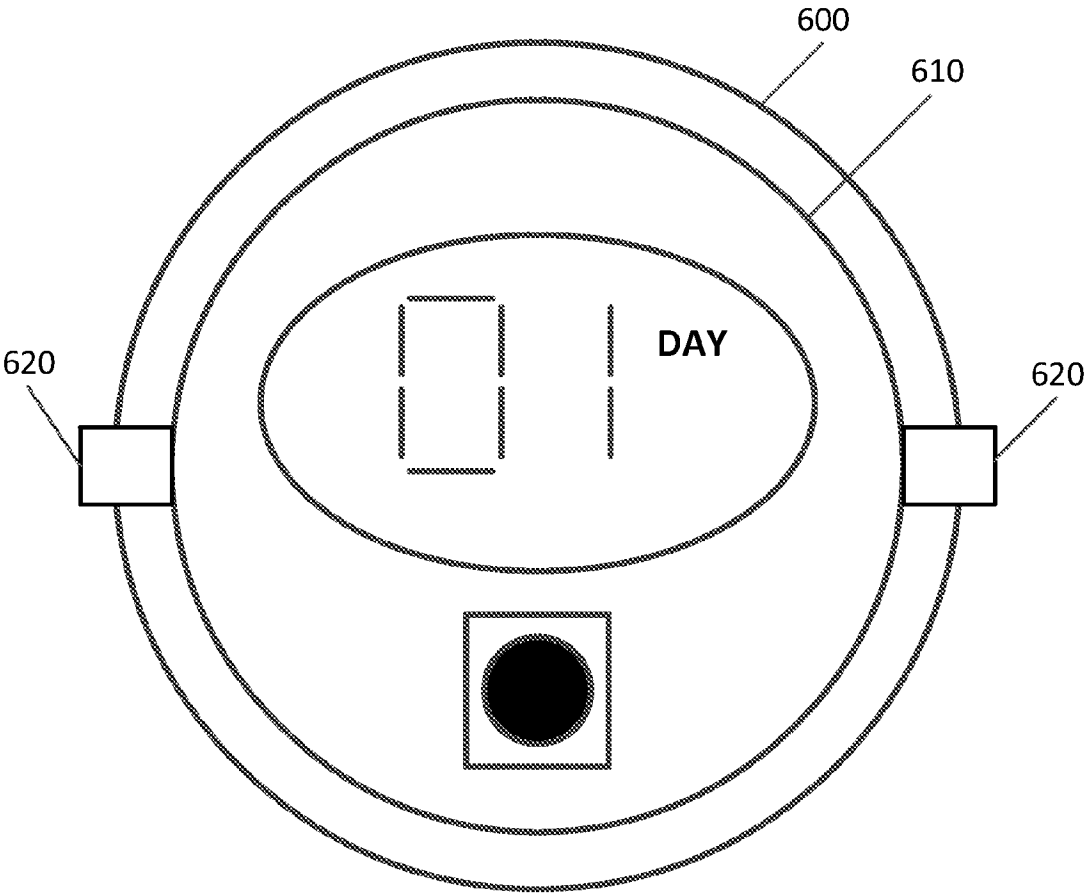
FIG. 6 is a top view of a contact lens case cap and a timer, according to an embodiment of the present invention.

FIG. 6 is a top view of a contact lens case cap 600 and a timer 610, according to an embodiment of the present invention. In some embodiments, the contact lens case cap 600 and timer 610 are identical to those illustrated in FIG. 5A. Timer 610 sits atop contact lens case cap 600. A strap 620 is operably connected to timer 610 and wraps around contact lens case cap 600 and a base (not shown due to perspective).

Figure 7:
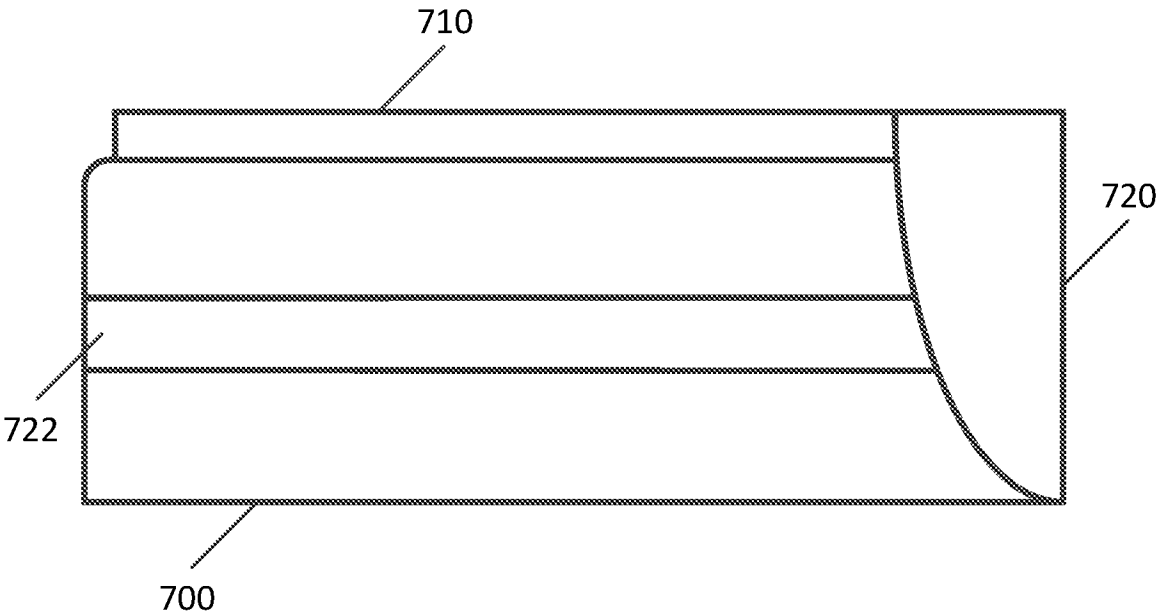
FIG. 7 is a side view of a contact lens case cap, a timer, and a securing mechanism, according to an embodiment of the present invention.

FIG. 7 is a side view of a contact lens case cap 700, a timer 710, and a securing mechanism, according to an embodiment of the present invention. In some embodiments, a manual counter is used in lieu of a timer. Timer 710 sits atop contact lens case cap 700. The securing mechanism includes a post member 720 and a strap 722. Post member 720 is operably connected to timer 710 and hangs over a side of contact lens case cap 700, contacting a lateral side of contact lens case cap 700. Strap 722 is operably connected to post member 720 and secures post member 720, and by extension timer 710, securely to contact lens case cap 700. In some embodiments, post member 720 may be constructed from a more rigid material than strap 722 in order to more securely fasten timer 710 in place. Strap 722 may be securable to contact lens case cap 700 in at least the manner discussed with respect to FIG. 5. In some embodiments, multiple post members with one or more straps therebetween may be present.

Figure 8:
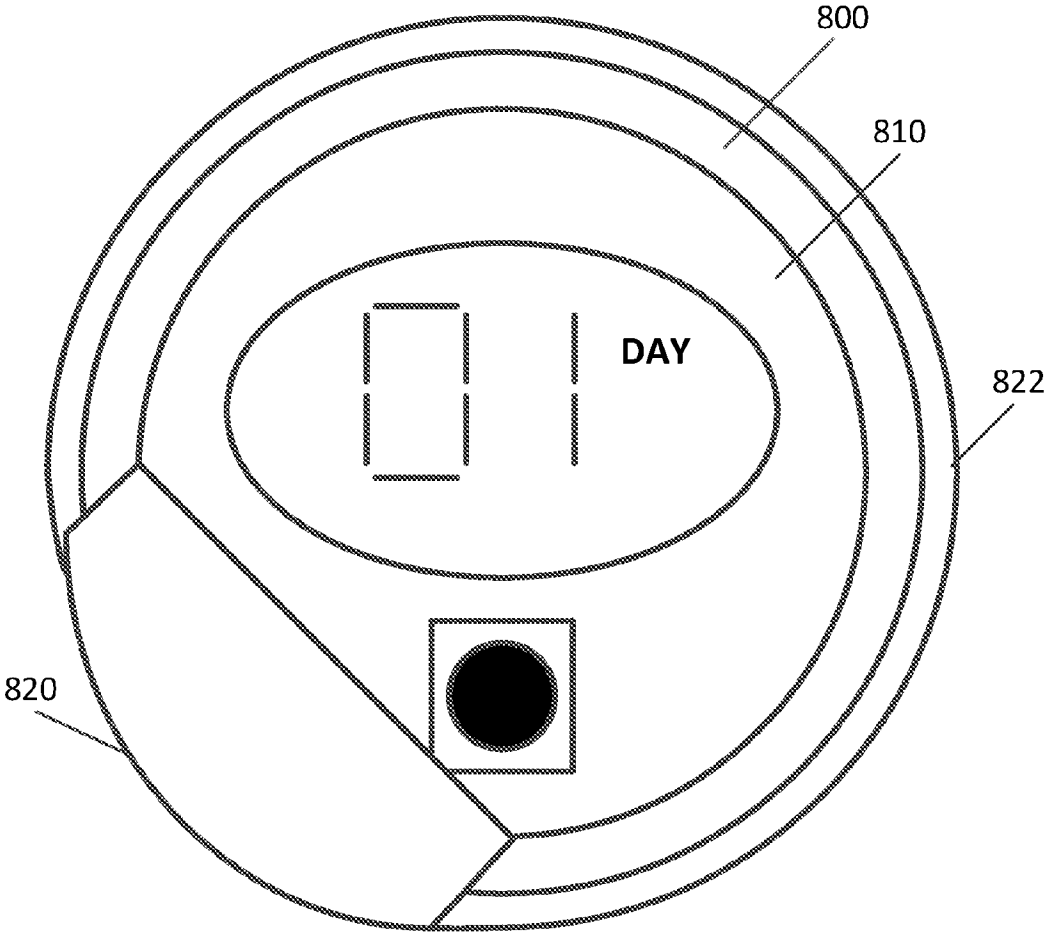
FIG. 8 is a top view of a contact lens case cap and a timer, according to an embodiment of the present invention.

FIG. 8 is a top view of a contact lens case cap 800 and a timer 810, according to an embodiment of the present invention. In some embodiments, contact lens case cap 800 and timer 810 are identical to those illustrated in FIG. 7. Timer 810 sits atop contact lens case cap 800. The securing mechanism includes a post member 820 and a strap 822. Post member 820 is operably connected to timer 810 and hangs over a side of contact lens case cap 800, contacting a lateral side of contact lens case cap 800. Strap 822 is operably connected to post member 820 and secures post member 820, and by extension timer 810, to contact lens case cap 800.

Figure 9:
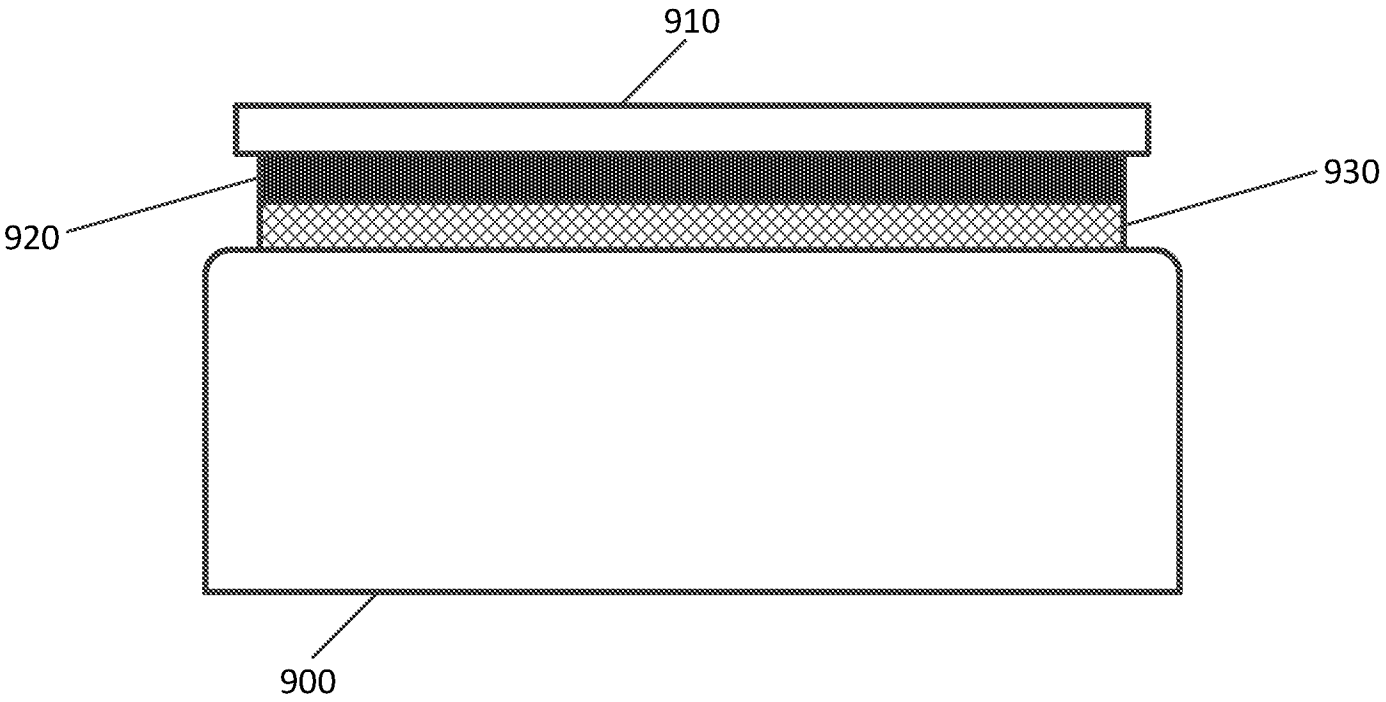
FIG. 9 is a side view of a contact lens case cap and a timer secured by magnets, according to an embodiment of the present invention.

FIG. 9 is a side view of a contact lens case cap 900 and a timer 910 secured by magnets, according to an embodiment of the present invention. In some embodiments, a manual counter is used in lieu of a timer. Magnet 920 is secured to timer 910 via an adhesive, solder, screw, bolt, or any other suitable mechanism. Similarly, magnet 930 is secured to the top of contact lens case cap 900. Magnets 920 and 930 have opposite charges so the magnets attract. Timer 910 is constructed in such a way that the magnetic fields do not interfere with the operation of timer 910.

Figure 10:
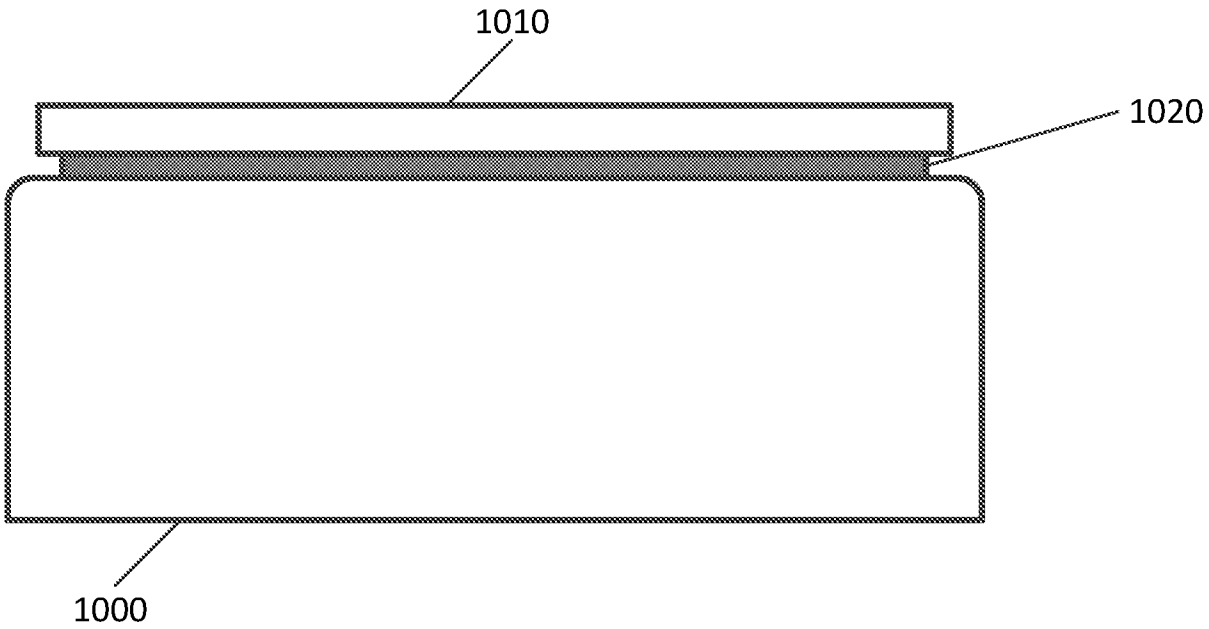
FIG. 10 is a side view of a contact lens case cap and a timer secured by a binding material, according to an embodiment of the present invention.

FIG. 10 is a side view of a contact lens case cap 1000 and a timer 1010 secured by a binding material 1020, according to an embodiment of the present invention. In some embodiments, a manual counter is used in lieu of a timer. Binding material 1020 may be glue, epoxy, a hook-and-loop fastener such as Velcro®, tape, or any other binding agent capable of securing timer 1010 to contact lens case cap 1000. The binding material may bind timer 1010 to contact lens case cap 1000 in a weak enough fashion that timer 1010 is easily removable by a user, or may be strong enough that removal is difficult. Also, the binding material may also for multiple removals and reattachments, or may have its binding ability substantially deteriorated or destroyed by removal of timer 1010.

Figure 11:
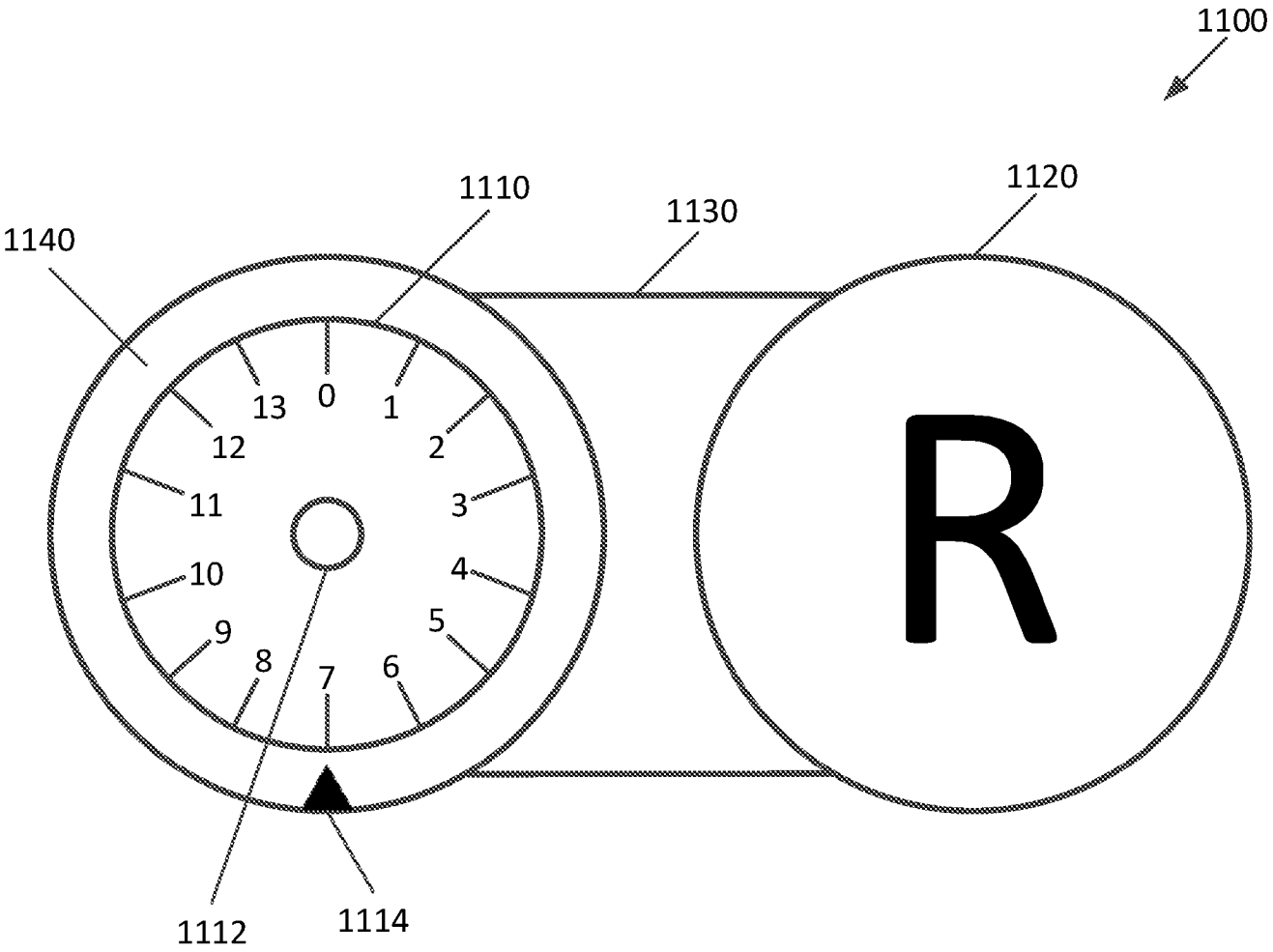
FIG. 11 is a top view of a contact lens case with a manual counter secured to the left contact lens cap, according to an embodiment of the present invention.

FIG. 11 is a top view of a contact lens case 1100 with a manual counter 1110 secured to the left contact lens cap, according to an embodiment of the present invention. The contact lens case includes a base 1130, a left contact lens case cap (obscured from view by manual counter 1110 and securing mechanism 1140), a right contact lens case cap 1120, a manual counter 1110, and a securing mechanism 1140. Manual counter 1110 is shown secured to the left contact lens case cap in this embodiment, but Manual counter 1110 could also be secured to right contact lens case cap 1120. Also, while only one timer is shown in this embodiment, a person of ordinary skill in the art will recognize that it is possible to secure a second manual counter to right contact lens case cap 1120. Such a configuration would allow tracking of the left and right contact lenses separately in case one has been lost or damaged and replaced at a different time, or the left and right contact lenses have different lifetimes.

Manual counter 1110 is secured around the left contact lens case cap, but does not interfere with the left contact lens case cap attaching to base 1130. Manual counter 1110 is a wheel with numbers from 0-13, representing a 14 day contact lens lifetime. Naturally, any lifetime may be represented. Manual counter 1110 is fastened either to securing mechanism 1140 or to a base plate (not shown), which is attached to the securing mechanism, via holding pin 1112. Holding pin 1112 may be a pin, bolt, or any other suitable means for facilitating the rotation of manual counter 1110. An arrow 1114 designates the current day on manual counter 1110. In this embodiment, securing mechanism 1140 envelops manual counter 1110, except for an opening for the display face of manual counter 1110.

Figure 12:
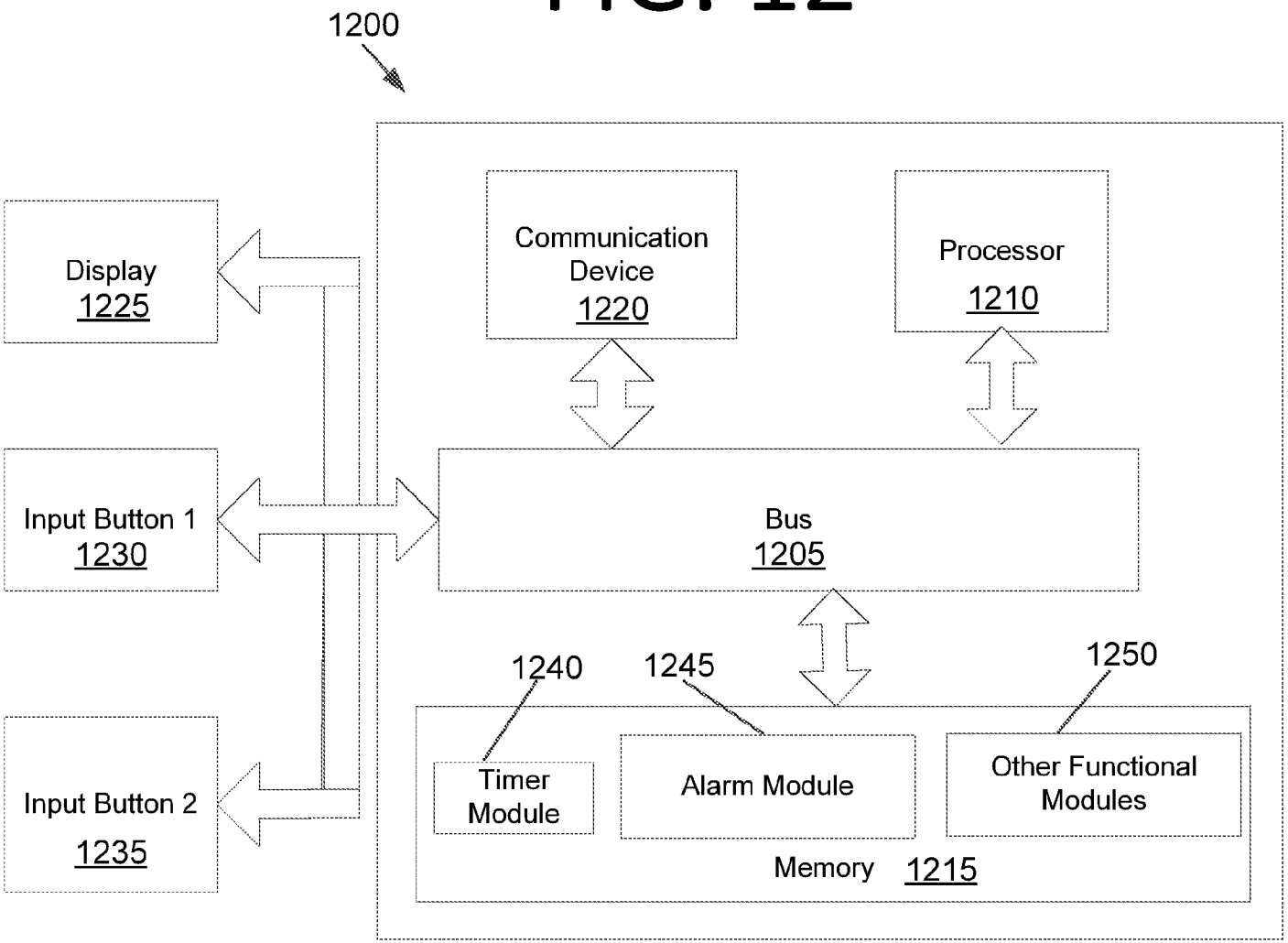
FIG. 12 is a digital controller, in accordance with an embodiment of the present invention.

In many embodiments, the operation of the timer is implemented by a digital controller. FIG. 12 illustrates a controller 1200, according to some embodiments of the present invention. Controller 1200 includes a bus 1205 or other communication mechanism for communicating information, and a processor 1210 coupled to bus 1205 for processing information. Processor 1210 may be any type of general or specific purpose processor, including a central processing unit ("CPU") or application specific integrated circuit ("ASIC"). Controller 1200 further includes a memory 1215 for storing information and instructions to be executed by processor 1210. Memory 1215 can be comprised of any combination of random access memory ("RAM"), read only memory ("ROM"), flash memory, cache, static storage such as a magnetic or optical disk, or any other types of computer-readable media or combination thereof. Additionally, controller 1200 includes a communication device 1220, such as a wireless network interface card, to provide wireless access to a network. However, such a communication device adds cost and may not be desired for many models, so it is not present in many embodiments.

Computer-readable media may be any available media that can be accessed by processor 1210 and may include both volatile and non-volatile media, removable and non-removable media, and communication media. Communication media may include computer readable instructions, data structures, program modules or other data in a modulated data signal such as a carrier wave or other transport mechanism and includes any information delivery media.

Processor 1210 is further coupled via bus 1205 to a display 1225, such as a Liquid Crystal Display ("LCD"), for displaying information, such as timing information, to a user. A first button 1230 and a second button 1235 are further coupled to bus 1205 to enable a user to interact with controller 1200.

In one embodiment, memory 1215 stores software modules that provide functionality when executed by processor 1210. The modules include a timer module 1240 that provides timing functionality for controller 1200. The modules further include an alarm module 1245 that is configured to facilitate an alarm when the timer expires. Controller 1200 may include one or more additional functional modules 1250 to include additional functionality.

Presenting the above-described functions as being performed by a "controller" is not intended to limit the scope of the present invention in any way, but is intended to provide one example of many embodiments of the present invention. Indeed, apparatuses disclosed herein may be implemented in localized and distributed forms consistent with computing technology.

It should be noted that some of the controller features described in this specification have been presented as modules, in order to more particularly emphasize their implementation independence. For example, a module may be implemented as a hardware circuit comprising custom very large scale integration (VLSI) circuits or gate arrays, off-the-shelf semiconductors such as logic chips, transistors, or other discrete components. A module may also be implemented in programmable hardware devices such as field programmable gate arrays, programmable array logic, programmable logic devices, graphics processing units, or the like.

A module may also be at least partially implemented in software for execution by various types of processors. An identified unit of executable code may, for instance, comprise one or more physical or logical blocks of computer instructions that may, for instance, be organized as an object, procedure, or function. Nevertheless, the executables of an identified module need not be physically located together, but may comprise disparate instructions stored in different locations which, when joined logically together, comprise the module and achieve the stated purpose for the module. Further, modules may be stored on a computer-readable medium, which may be, for instance, a hard disk drive, flash device, random access memory (RAM), tape, or any other such medium used to store data.

Indeed, a module of executable code could be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

Some embodiments of the present invention provide a timer or counter that is securable to a contact lens case cap. The timer or counter may be secured by a securing mechanism that envelops the timer or counter, a strap, a post member with a strap, magnets, adhesives, or any other suitable mechanism. Such a timer or counter may be attached to contact lens cases of varying sizes and has a utility and portability that other timers and counters in the art lack.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An apparatus, comprising:

a timer or a manual counter configured to track a time that one or more contact lenses have been stored in a contact lens case; and a securing mechanism configured to secure the timer or the manual counter to a cap of the contact lens case, wherein the securing mechanism at least partially wraps around the cap to secure the timer or manual counter to the cap, the securing mechanism elastically deforms to at least partially wrap around caps of different sizes, sides of the cap and corresponding portions of the securing mechanism contacting the sides of the cap remain flush with one another when the securing mechanism is secured to the cap, and the securing mechanism leaves a lower portion of a side of the cap exposed when the securing mechanism is secured to the cap.

2. The apparatus of claim 1, wherein the securing mechanism is operably connected to the timer.

3. The apparatus of claim 1, wherein the timer further comprises a digital display and the securing mechanism is configured to envelop the timer such that the timer is secured to the cap of the contact lens case, but the digital display is visible.

4. The apparatus of claim 1, wherein the securing mechanism is secured to the contact lens case cap such that the contact lens case cap is removable from a base of the contact lens case.

5. The apparatus of claim 1, wherein the timer further comprises one or more buttons configured to control the operation of the timer.

6. The apparatus of claim 5, wherein the timer further comprises one or more speakers configured to generate sound in response to user interaction via the buttons, and to generate an alarm when a time for one or more contact lenses expires.

7. The apparatus of claim 1, wherein the time is adjustable by the user.

8. The apparatus of claim 1, wherein the securing mechanism fully wraps around the cap to secure the timer or the manual counter to the cap.

9. The apparatus of claim 1, wherein the securing mechanism slides over the timer or manual counter and holds the timer or manual counter in place against the cap.

* * * * *